US006802912B2

(12) United States Patent
Bogar et al.

(10) Patent No.: US 6,802,912 B2
(45) Date of Patent: Oct. 12, 2004

(54) DEFERRIZING FLUX SALT COMPOSITION FOR FLUX BATHS

(75) Inventors: Georg Bogar, Reilingen (DE); Helmut Herwig, Hagen (DE); Harald Ernst, Heidelberg (DE)

(73) Assignee: Goldschmidt AG, Essen (DE)

( * ) Notice: Subject to any disclaimer, the term of this patent is extended or adjusted under 35 U.S.C. 154(b) by 202 days.

(21) Appl. No.: 10/196,654

(22) Filed: Jul. 15, 2002

(65) Prior Publication Data

US 2003/0084755 A1 May 8, 2003

(30) Foreign Application Priority Data

Jul. 17, 2001 (DE) ..... 101 34 812

(51) Int. Cl.[7] ..... B23K 35/362
(52) U.S. Cl. ..... 148/23; 148/26
(58) Field of Search ..... 148/23, 26

(56) References Cited

U.S. PATENT DOCUMENTS 4,496,612 A * 1/1985 McNutt et al. ..... 427/310
5,100,486 A * 3/1992 Krikorian et al. ..... 148/248
5,810,946 A * 9/1998 Cudahy et al. ..... 148/26
6,270,842 B1 * 8/2001 Uchida et al. ..... 427/310

FOREIGN PATENT DOCUMENTS

| | | | |
|---|---|---|---|
| DE | 20 29 580 | 12/1971 | |
| DE | 38 14 372 | 11/1989 | |
| EP | 0150251 A1 * | 8/1985 | ..... C23C/2/30 |
| EP | 0989208 A2 * | 3/2000 | ..... C25D/3/66 |

OTHER PUBLICATIONS

Maass et al., "Feuerverzinken" [Hot–dip galvanization] Handbook, 2nd Edition, Deutscher Verlag Für Grundstoffindustrie, Leipzig, 1993, P. 70–72.
Adolf Bohm, "Abwassertechnik in Feuerverzinkereien", No. 11, pp. 235–239, 1974.

* cited by examiner

*Primary Examiner*—Daniel Jenkins
(74) *Attorney, Agent, or Firm*—Frommer Lawrence & Haug LLP

(57) ABSTRACT

The invention relates to a flux salt composition for flux baths which is available for particularly simple regeneration and deferrizing.

The deferrizing flux salt composition for flux baths, containing zinc chloride and alkali metal chloride, contains at least one or more alkalizing constituents and one or more constituents which, in aqueous solution, oxidize iron(II) to form iron(III).

33 Claims, No Drawings

DEFERRIZING FLUX SALT COMPOSITION FOR FLUX BATHS

RELATED APPLICATIONS

This application claims priority to German application No. 161 34 812.6, filed Jul. 17, 2001.

BACKGROUND OF THE INVENTION

1. Field of the Invention

The invention relates to a flux salt composition for flux baths which is accessible for particularly simple regeneration and deferrizing.

2. Description of the Related Art

To achieve a high-quality zinc coating, the workpieces which are to be galvanized pass through a number of process steps prior to the hot-dip galvanization. After a degreasing stage to remove organic contaminants and a subsequent pickling stage for the acidic removal of oxidic contaminants, the workpieces, after rinsing, pass through a pretreatment stage in a flux bath which contains the fluxing agent solution. The purpose of this bath is to protect the workpieces from corrosion on their way to the zinc bath and during drying.

Fluxing agent solutions are aqueous salt solutions with a salt content of 300 to 500 g/l. The main constituents of these flux salts are zinc chloride and ammonium chloride. In addition, there may be lesser quantities of various alkali metal and alkaline earth metal chlorides (for example KCl, NaCl, $MgCl_2$, $CaCl_2$). In the case of low-fume flux salts, in particular salt mixtures, which, however, on account of the lower pickling effect are only seldom employed, the ammonium chloride content is mostly replaced by KCl.

In the case of dry galvanizing, the flux salt is applied to the material to be galvanized by dipping the workpiece into the fluxing agent solution. Even during drying there is a certain pickling effect on account of the formation of hydroxozinc acids. On dipping into the zinc pot, the dried-on flux salt is melted. For the activity of flux salts, it is important for their melting point to be well below the temperature of the zinc bath (approximately 450° C.), so that they can rapidly effect their pickling action. The pickling action is based on the release of hydrochloric acid, which is preferably formed from ammonium chloride in the temperature range from 250 to 320° C. This hydrochloric acid dissolves oxide contaminants.

During operation, foreign substances accumulate in the fluxing agent solution as a result of carry-over. Even when the degreasing stage is carried out carefully, it is impossible to completely prevent organic substances from being carried over into the subsequent pickling stage and onward into the flux bath. However, the iron which is carried over from the pickling baths is of relatively considerable importance. The iron accumulates in the pickling solution in the form of $FeCl_2$, it being possible for the iron contents to be in the order of magnitude of 100 to 160 g/l. Alloying constituents of the steel grades used during pickling are also dissolved to a small extent. The introduction of iron salts, hydrochloric acid, pickling inhibitors and alloying constituents into the downstream flux bath is highly dependent on the rinsing technique employed, but cannot be avoided entirely even in the event of a high outlay on rinsing.

The pickling action of the flux salt itself plays a role as a further source of contaminants. The flux bath contains different proportions of hydrochloric acid, with the result that iron and alloying elements are dissolved out of the material to be galvanized in small quantities.

Iron which is introduced with the flux salt into the galvanizing vessel during hot-dip galvanization reacts with the elemental zinc and forms hard zinc (iron/zinc solid solutions), which precipitates as a solid in the zinc vessel. 1 g of iron forms approximately 25 g of hard zinc (Böohm, 1974, "Abwassertechnik in Feuerverzinkereien" [Wastewater technology in hot-dip galvanization plants] 12 (1974) No. 11, 235–239). The zinc losses are therefore considerable, and consequently the iron content in the flux bath should not exceed 10 g/l (Maaβ, Peiβker "Feuerverzinken" [Hot-dip galvanization] Handbook, 2nd edition, Deutscher Verlag für Grundstoffindustrie, Leipzig, 1993, p. 72). Hitherto, however, the flux salts have often been replaced only at iron contents of 80 to 100 g/l, and in extreme cases even only at 150 g/l. If the iron concentrations are high, the galvanization quality is impaired in addition to the zinc losses. Hard zinc crystals, which float in the zinc melt, settle on the surface of the material which is being galvanized and then appear as what are known as pimples. In addition to pimples, other flaws may also occur. For example, the presence of fine hard zinc crystals may locally increase the viscosity of the zinc melt to such an extent that when the workpieces are pulled out of the zinc pot, galvanization flaws, such as streaks and what are known as curtains, are formed. In the flux bath, pickling acid which has been carried over also results in increased dissolution of iron and therefore in an increased formation of hard zinc in the zinc pot. Old fluxes may have acid contents of more than 10 g/l and therefore a pH of less than 1.

The concentration of the carried-over organic substances from the degreasing and the pickling in the flux bath is generally low and does not have any adverse effects on quality during the galvanization. However, the organic substances are reacted in the zinc pot with the reaction partners which are present (for example zinc, chlorine, ammonium) in an uncontrolled fashion, so that pollutant-containing reaction products (for example dioxin-containing reaction products) may form, and these products, in relatively large quantities, lead to operating problems in the cleaning of the outgoing air (blocking of the filters) and make it more difficult or impossible to recycle the filter dusts which have been separated out.

Therefore, contaminated flux baths have to be exchanged regularly, the iron content which leads to replacement in hot-dip galvanization plants fluctuating within wide ranges (40 to over 80 g/l). In the past, it has only been possible to recover a small proportion of the constituents when recycling old fluxes of this type, while the majority has had to be disposed of as special waste. These methods of the prior art are generally based on using a multistage process in which, first of all, the pH is set to between 3.5 and 4, and then the divalent iron which is present in the flux bath is precipitated as iron(III) hydroxide through the addition of hydrogen peroxide, and is then separated from the fluxing agent solution by filtration in an operation which is complex and lengthy, on account of the streaky consistency of these iron hydroxide flocs. Only some of the fluxing agent solution can be reused in this method. A variant on this method, in which in each case only some of the fluxing agent solution is treated in a separate installation, is described in DE 20 29 580 C3. The fundamental drawbacks, namely the low level of reutilization and the complex method, as well as the fact that the operating staff are exposed to toxic and etching chemicals, however, are not overcome. Since the recovery of flux salt is low in the method described, many galvanization plants do not make the effort to recycle the fluxing agent solution and prefer to dispose of the entire fluxing agent solution when the iron content of the fluxing agent solution has risen to a defined maximum level. This means that considerable environmental pollution by heavy metal salts is unavoidable.

An alternative method is described in DE 38 14 372 A1. According to this method, a certain quantity is continuously or discontinuously removed from the flux bath and is rendered alkaline using a lye in a separate reactor and provided with an oxidizing agent in order to oxidize iron(II) to iron(III). This iron is bonded in an ion exchanger, preferably using hydrochloric acid, and is returned to the pickling tank after it has been separated out as iron-laden re-extraction acid. The fluxing agent solution from which iron has been removed is fed back to the flux bath after this method has been carried out. This method has the drawback of being complex and expensive and not ensuring that carried-over organic contaminants are eliminated.

A method which allows the active materials contained in the old fluxes to be almost completely recovered and the foreign substances, in particular iron and organic contaminants, to be quantitatively separated out, has been proposed in the prior art. With this method, the principle of circulation through external treatment is used to obtain, from the old fluxes, a fluxing agent solution which is as good as new and is reused in the galvanization plants. Organic contaminants are destroyed or are concentrated in a precipitation slurry, the quantitative levels and hazardous potential of which are considerably lower than with other methods which are known from the prior art. However, for process engineering reasons this method can only be used to process old flux solutions with iron contents of up to 20 g/l, which requires the flux bath to be changed more frequently, which is more than compensated for by the economic and ecological advantages of complete recycling of the flux salt, the low pollutant content of the waste sludge and the considerably improved quality of galvanization. In the method, first of all hydrogen peroxide and ammonia are added to the old flux in a number of method steps, in order to precipitate iron, and then the organic impurities are broken down by the addition of potassium permanganate. After the iron hydroxide sludge has been filtered out, manganese(II) which is included is oxidized to manganese dioxide using hydrogen peroxide and is separated out by filtration, with the result that, ultimately, a fluxing agent solution which is as good as new is obtained.

However, this method of the prior art likewise involves a number of stages and in particular is reliant on the old fluxes being reprocessed centrally, entailing high transport costs, and having to be returned to the galvanization plants in liquid form.

OBJECTS OF THE INVENTION

Therefore, in view of the increasing focus on galvanization plants with regard to environmental protection and the efforts made by the galvanizing operators to carry out the recycling of the fluxing agent solution under their own auspices, an object of the present invention is to provide a flux salt composition which allows simple recycling of the fluxing agent solution in one step and is not reliant on external, central recycling installations. As a result, the flux can be used even in markets which are not accessible for conventional recycling methods, for reasons of transport costs, for example overseas countries.

SUMMARY OF THE INVENTION

According to the invention, the above objects are achieved by a deferrizing flux salt composition for flux baths, containing zinc chloride and alkali metal chloride, which contains at least one or more alkalizing constituents and one or more constituents which, in aqueous solution, oxidize iron(II) to iron(III).

DETAILED DESCRIPTION OF THE INVENTION

The reprocessing in one step simplifies the method which is usually preferred in galvanization plants, namely of adjusting the pH using ammonia water and oxidizing using hydrogen peroxide. At the same time, the flux salt used keeps the chemical composition of the fluxing agent solution constant. It is also possible to dispense with the operation of setting the zinc chloride ammonium chloride ratio by adding zinc chloride powder after an operating time of a few weeks. Three working steps are replaced by one step, considerably simplifying operation.

To set the desired ratio of zinc chloride to alkali metal chloride, in order to ensure a eutectic (low-melting) flux salt mixture on the material being galvanized, a preferred embodiment of the flux salt composition according to the invention contains about 10 to about 80% by weight, preferably about 25 to about 70% by weight, particularly preferably about 50 to about 70% by weight of zinc chloride, based on the salt content of the flux salt.

In addition, the flux salt composition is to contain from about 20 to about 90% by weight, in particular about 30 to about 75% by weight, particularly preferably 30 to 50% by weight of alkali metal chloride, based on the salt content of the flux salt.

Ammonium chloride is particularly preferred in this respect, on account of its additional pickling action through the release of HCl in the galvanization bath.

As alkalizing constituent, the flux salt composition according to the invention may contain in particular zinc oxide, alkali metal hydroxides, in particular lithium hydroxide, sodium hydroxide and/or potassium hydroxide, metal carbonates, in particular zinc carbonate, or a combination thereof, in a preferred embodiment from about 1 to about 20% by weight, preferably about 2 to about 10% by weight, particularly preferably about 3 to about 7% by weight, of zinc oxide, based on the flux salt.

Alkali metal permanganate, especially potassium permanganate, is advantageous as an oxidizing constituent, since it can oxidize both iron and organic contaminants, and manganese(II) which forms can be removed again as manganese dioxide using methods which are known per se, but it is also possible to use metal peroxides and/or metal chlorates, such as zinc peroxide or zinc chlorate, as oxidizing constituents.

The quantity of permanganate included ideally results from the stoichiometric demand for oxidation of all the included iron(II) to form iron(III). Consequently, a content of from about 0.1 to about 15% by weight, preferably about 0.5 to about 10% by weight, particularly preferably about 1 to about 5% by weight, of alkali metal permanganate, in this case in particular potassium permanganate, based on the flux salt in the flux salt composition, is highly advantageous.

A further preferred embodiment of the present invention relates to a fluxing agent solution which is used to treat iron-containing metal surfaces prior to the galvanization and contains a flux salt of the above composition. In particular, this fluxing agent solution is to have a concentration of less than about 40 g/l, preferably less than about 30 g/l, and particularly preferably less than about 25 g/l of iron, since a high iron content, as stated above, leads to the formation of hard zinc and to a reduced quality of galvanization.

Also, the reaction temperature during reprocessing of the old flux, on account of the exothermic oxidation of iron(II) to iron(III), exceeds the optimum range if the iron(II) content of the old flux is over about 35 to about 40 g/l, in which case coolers have to be used. Therefore, the reprocessing is expediently carried out at temperatures of less than about 60 to about 70° C., since above this temperature problems arise in galvanization plants as a result of the evaporation of water.

During operation of the flux bath for treatment of iron-containing metal surfaces prior to the galvanization, which comprises treatment of flux baths (old fluxes) which contain iron as a result of iron carry-over from standard operation, according to the invention the zinc chloride/alkali metal chloride ratio and the pH for iron precipitation and the oxidation of iron(II) to form iron(III) are carried out in one step by continuous or discontinuous addition of a flux salt composition as described. This considerably simplifies the method compared to the methods which are described in the prior art and can also be carried out on a decentralized basis in the galvanization plants, even by untrained staff.

To operate the flux bath, the flux salt composition may be used in solid form or having been dissolved in water before being added. An optimum effect is achieved if, to operate the flux bath with the addition of the flux salt, the pH of the flux bath is set in a range from about 3.0 to about 4.5, preferably from about 3.3 to about 4.0, particularly preferably at 3.8, and iron(II) which is present in the solution as a result of galvanization is oxidized to form iron(III) and is precipitated. For the reasons described above, it is advantageous for this to be effected when the iron content of the old flux is from about 5 to about 40, preferably about 10 to about 30, particularly preferably about 15 to about 25 g/l.

The addition of permanganate may, over the course of time, cause manganese to accumulate in the old flux. This manganese should be precipitated and removed from time to time, for example by comproportionation with potassium permanganate or by oxidation with hydrogen peroxide or in some other way.

EXAMPLES

Example 1

A standard flux, which has been sufficiently trialed in practice, has a good buffering action and ensures a pH of from 3 to 3.8, was selected. This flux has become well established and has gained widespread acceptance in galvanization plants.

Having considered all the possible chemical influences and having performed a risk assessment, the oxidizing agent selected according to the invention was potassium permanganate, which was admixed with the flux.

To determine the required concentration of potassium permanganate and ultimately the flux concentration to be employed, standard values from an average galvanization plant were employed.

Standard Values

Flux bath size: 20 $m^3$, corresponds to approximately 24 t; annual throughput of material to be galvanized, approximately 10000 t; flux salt consumption, approximately 1.5 kg/t of material to be galvanized=15 t of flux per year, annual iron carry-over up to 20 g of Fe/l, i.e. amount of iron to be oxidized 400 kg/year; carry-out loss 0.5 $m^3$ per week.

A mixture containing 2% of potassium permanganate was selected for large-scale industrial use.

The flux salt had the following composition (% by weight):

54% of zinc chloride (crystalline)
5% of zinc oxide solid
40% of ammonium chloride
2% of potassium permanganate As a result, the levels of iron over the course of a few months of operation were pushed toward zero, so that the manganese could then be removed from the flux bath by using an excess of potassium permanganate.

Example 2

In zinc chloride mode, a batch of 500 kg of the flux was produced in accordance with Example 1, and samples were taken in order to test its operation on a laboratory scale.

Laboratory Batch 1 l of an old flux with the following parameters was tested:

| | |
|---|---|
| $ZnCL_2$: | 23.8% |
| $NH_4Cl$: | 8.1% |
| Fe: | 2.1% = 26.75 g/l |
| Mn: | 200 ppm |
| HCl: | 0.3% |
| pH: | <1.0 |
| Density: | 1.274 g/ml |

This flux bath proved to be ideal for carrying out the tests, since in particular the ratio of zinc chloride to ammonium chloride deviated considerably from the optimum ratio.

Before the start of fluxing, the pH of the flux bath was set to 3.0 using 10 ml of 50% strength NaOH.

25 ml were removed from this set flux batch (corresponding to Al in Table 1), which corresponds to the weekly carry-out loss of 0.5 $m^3$ from a standard bath of 20 $m^3$.

The 25 ml which had been removed were topped up again by 25 ml of a fluxing agent solution according to the invention in accordance with Example 1, with a concentration of 400 g of flux/l or 400 kg/$m^3$, which is a standard operating concentration in a galvanization plant, followed by stirring for approximately 1 hour.

After a few seconds, an intensive brown color was formed, and very rapid decanting took place after the stirring operation had ended. The pH rose from 3.0 to 3.8.

After one day, a specimen was removed and the reduction of iron and the composition of the flux components were tested (cf. A2 in Table 1). The specimen of the old flux solution was mixed with a few drops of HCl, and the pH was restored from 2.8 to 3.0, in order to simulate the carry-over of HCl.

This procedure was carried out a total of four times, in order to simulate the four-weekly operation of a bath. After each cleaning run, an analysis (corresponding to A2 to A5 in Table 1) was carried out, in order to monitor the deferrizing.

Summary of the Results

Each time flux was added, the pH rose from approximately 3.0 to approximately 3.8. This is an optimum level for iron(III) hydroxide precipitation.

The zinc chloride/ammonium chloride composition has not changed significantly.

For samples A4 and A5 from Table 1, it is possible to recognize a slight improvement in the zinc chloride/ammonium chloride ratio.

The levels of iron dropped from 26.75 g/l to 20.4 g/l. Based on the carry-over quantity of iron to be removed of 480 kg per annum, 127 kg of iron have been separated out each month. Taking account of freshly carried over iron, approximately 2 g/l per month, given consistent use of the deferrizing flux the bath would be free of iron within 5 months. Over this time, the manganese content would rise to 1000 ppm.

At the latest at this time, this content could be eliminated by forming $MnO_2$ with free $KmnO_4$.

The iron-free and manganese-free bath can then be operated, for example, for a year using conventional flux salt. The deferrizing step can be resumed once an iron content of preferably 20 g/l is reached again.

A procedure which involves one month of deferrizing followed by two months using a conventional flux salt is also conceivable. In this case, the increase in manganese is reduced again as a result of the manganese being discharged.

The discoveries which have been made leave ample room to meter the fluxes used in such a manner that they are accurately matched to the requirements of any particular galvanization plant.

TABLE 1

Measurement report for the flux bath analyses.

| | A1 | A2 | A3 | A4 | A5 |
|---|---|---|---|---|---|
| $ZnCl_2$ | 303 | 303 | 292 | 303 | 290 g/l |
| $NH_4Cl$ | 102 | 102 | 103 | 105 | 107 g/l |
| Fe | 26.7 | 25.5 | 23.9 | 22.6 | 20.4 g/l |
| Mn | 200 | 220 | 240 | 340 | 380 ppm |
| Density | 1.274 | | | | 1.270 g/ml |
| TOC* | 100 | | | | 110 ppm |

*Total Organic Carbon (total content of organic carbon in the solution)

The above description of the invention is intended to be illustrative and not limiting. Various changes or modifications in the embodiments described herein may occur to those skilled in the art. These changes can be made without departing from the scope or specification of the invention.

What is claimed is:

1. A deferrizing flux salt composition for flux baths, which comprises zinc chloride and alkali metal chloride, one or more alkalizing constituents and one or more oxidizing constituents which, in aqueous solution, oxidize iron(II) to form iron(III), wherein the deferrizing flux salt composition comprises from about 10 to about 80% by weight of zinc chloride, based on the salt content of the flux salt.

2. The deferrizing flux salt composition, according to claim 1, which comprises from about 25% to about 70% by weight of zinc chloride, based on the salt content of the flux salt.

3. The deferrizing salt composition according to claim 1, which comprises from about 50 to about 80% by weight of zinc chloride, based upon the salt content of the flux salt.

4. The deferrizing flux salt composition as claimed in claim 1, which comprises from about 20 to about 90% by weight of alkali metal chloride, based on the salt content of the flux salt.

5. The deferrizing flux salt composition as claimed in claim 4, wherein the alkali metal chloride is ammonium chloride.

6. The deferrizing flux salt composition as claimed in claim 4, which comprises from about 30 to about 75% by weight of alkali metal chloride, based on the salt content of the flux salt.

7. The deferrizing flux salt composition as claimed in claim 4, which comprises from about 30 to about 50% by weight of alkali metal chloride, based upon salt content of the flux salt.

8. The deferrizing flux salt composition as claimed in claim 1, wherein the alkalizing constituent comprises metal oxides, alkali metal hydroxides, metal carbonates, or a combination thereof.

9. The deferrizing flux salt composition as claimed in claim 8, wherein the metal oxide is zinc oxide, the alkali metal hydroxide is selected from the group consisting of lithium hydroxide, sodium hydroxide and potassium hydroxide, and the metal carbonate is zinc carbonate.

10. The deferrizing flux salt composition as claimed in claim 9, which comprises from about 1 to about 20% by weight of zinc oxide, based on the salt content flux salt.

11. The deferrizing flux salt composition as claimed in claim 9, which comprises from about 2 to about 10% by weight of zinc oxide, based on the salt content flux salt.

12. The deferrizing flux salt composition as claimed in claim 9, which comprises about 3% to about 7% of zinc oxide, based upon the salt content of the flux salt.

13. The deferrizing flux salt composition as claimed in claim 1, wherein the oxidizing constituent comprises alkali metal permanganate, metal peroxides, metal chlorate or a combination thereof.

14. The deferrizing flux salt composition as claimed in claim 13, wherein the oxidizing constituent is potassium permanganate, zinc peroxide, zinc chlorate or a combination thereof.

15. The flux salt composition as claimed in claim 13, which comprises from about 0.1 to about 15% by weight, of alkali metal permanganate based upon the salt content of the flux salt.

16. The flux salt composition as claimed in claim 15, which comprises from about 0.5 to about 10% by weight, of alkali metal permanganate based upon the salt content of the flux salt.

17. The flux salt composition as claimed in claim 15, which comprises from about 1 to about 5% of alkali metal permanganate, based upon the salt content of the flux salt.

18. The flux salt composition according to claim 15, wherein the alkali metal permanganate is potassium permanganate.

19. The deferrizing flux salt composition according to claim 1, which comprises from about 10 to about 80% alkali metal chloride; from about 20 to about 90% one or more alkalizing constituents selected from the group consisting of metal oxides, alkali metal hydroxides, metal carbonates and a combination of the foregoing, and from about 1% to about 20% one or more oxidizing constituents selected from the group consisting of alkaline metal permanganate, metal peroxides, metal chlorates and a combination of the foregoing, said weigh percents based on the salt content of the flux salt.

20. A fluxing agent solution for the treatment of iron-containing metal surfaces prior to galvanization, which comprises the deferrizing flux salt composition as claimed in claim 1.

21. The fluxing agent solution as claimed in claim 20, wherein the after treatment of iron-containing metal surface, the fluxing agent solution has an iron content has a concentration of less than about 40 g/l.

22. The fluxing agent solution as claimed in claim 21, wherein the fluxing agent has an iron concentration of less than about 30 g/l.

23. The fluxing agent solution as claimed in claim 21, wherein the fluxing agent has an iron content of less than about 25 g/l.

24. A method for treating iron-containing metal surfaces prior to galvanization which comprises placing said iron-containing metal surfaces in a flux bath containing a fluxing agent solution comprising zinc chloride and alkali metal chlorides wherein said fluxing agent solution is recycled in one step, during which the ratio of zinc chloride and alkali metal chloride and the pH for iron precipitation is adjusted and the formation of iron (III) from iron (II) occurs in the fluxing agent solution, said recycling step comprises adding a deferrizing flux salt composition for flux baths, which comprises zinc chloride and alkali metal chloride, one or more alkalizing constituents and one or more oxidizing constituents which, in aqueous solution, oxidize iron(II) to form iron(III) in a continuous or a discontinuous manner.

25. The method as claimed in claim 24, wherein the flux salt composition is dissolved in water before it is added.

26. The method as claimed in claim 25, wherein the pH of the flux bath is set within a range from about 3.0 to about 4.5, whereby the iron (III) is precipitated from the flux bath.

27. The method as claimed in claim 26, wherein the pH is in a range from about 3.3 to about 4.0.

28. The method as claimed in claim 25, wherein the pH is 3.8.

29. The method as claimed in claim 24, wherein the flux salt composition is added when the iron content of the fluxing agent solution is from about 5 to about 40 g/l.

30. The method according to claim 24, wherein the flux salt is added when the iron content of the fluxing agent solution is from about 10 to about 30 g/l.

31. The method according to claim 24, wherein the flux salt is added when the iron content of the fluxing agent solution is from about 5 to about 25 g/l.

32. The method according to claim 24, wherein manganese, which accumulates in the fluxing agent solution after treatment of the iron-containing metal surface, is precipitated and removed.

33. The method according to claim 32, wherein the manganese is precipitated as manganese dioxide.

* * * * *